US011307528B2

(12) United States Patent
Morita

(10) Patent No.: US 11,307,528 B2
(45) Date of Patent: Apr. 19, 2022

(54) IMAGE FORMING APPARATUS HAVING A LOCKING MECHANISM FOR A UNIT

(71) Applicant: KYOCERA Document Solutions Inc., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/327,321

(22) Filed: May 21, 2021

(65) Prior Publication Data

US 2021/0373486 A1 Dec. 2, 2021

(30) Foreign Application Priority Data

May 26, 2020 (JP) ..... JP2020-091630
Dec. 4, 2020 (JP) ..... JP2020-201474

(51) Int. Cl.
*G03G 21/16* (2006.01)
*G03G 21/18* (2006.01)

(52) U.S. Cl.
CPC ..... *G03G 21/1647* (2013.01); *G03G 21/168* (2013.01); *G03G 21/1623* (2013.01); *G03G 21/1846* (2013.01)

(58) Field of Classification Search
CPC ..... G03G 21/1642; G03G 21/1647; G03G 21/168; G03G 21/1842; G03G 21/1846; G03G 2221/1642; G03G 2221/1654; G03G 21/1623
See application file for complete search history.

(56) References Cited

U.S. PATENT DOCUMENTS

2008/0138111 A1* 6/2008 Ju ..... G03G 21/1647 399/121
2017/0300003 A1 10/2017 Tokoro ..... G03G 21/168
2021/0240127 A1* 8/2021 Park ..... G03G 21/1846

FOREIGN PATENT DOCUMENTS

JP 2000-147977 A 5/2000
JP 2017-194490 A 10/2017

* cited by examiner

*Primary Examiner* — Sophia S Chen
(74) *Attorney, Agent, or Firm* — Stein IP, LLC

(57) ABSTRACT

An image forming apparatus includes a first unit dismountably mounted on a main body frame and a locking mechanism releasably holding the first unit mounted. The locking mechanism has a handle portion, a lock member, and a preloading member. The handle portion is on the first unit, and is movable to and fro in the mounting and dismounting directions of the first unit. The lock member is swingably on the first unit, and has a hook portion engageable with an engaged portion formed on the main body frame. The preloading member preloads the lock member in a first direction in which the hook portion engages with the engaged portion. As the handle portion is moved in the dismounting direction, the lock member swings in a second direction opposite to the first direction against the preloading force of the preloading member to disengage the hook portion from the engaged portion.

10 Claims, 14 Drawing Sheets

IMAGE FORMING APPARATUS HAVING A LOCKING MECHANISM FOR A UNIT

INCORPORATION BY REFERENCE

This application is based on and claims the benefit of Japanese Patent Applications Nos. 2020-091630 and 2020-201474 filed on May 26, 2020 and Dec. 4, 2020 respectively, the contents of both of which are hereby incorporated by reference.

BACKGROUND

The present disclosure relates to an image forming apparatus incorporating a unit, such as an intermediate transfer unit, that is dismountably mounted in the main body of the apparatus.

Various image forming apparatuses have conventionally been proposed. Among them are those of an intermediate transfer type, which comprise an endless intermediate transfer belt that is moved around in a predetermined direction and a plurality of image forming portions provided along the intermediate transfer belt, wherein toner images are overlaid on each other sequentially on the intermediate transfer belt by those image forming portions and are then transferred to a recording medium at once.

In an image forming apparatus of the intermediate transfer type as mentioned above, the intermediate transfer belt, which has shorter durable years than the apparatus as a whole, has to be replaced regularly. To cope with that, a wide use is made of a construction that permits an intermediate transfer unit including the intermediate transfer belt to be dismountably mounted in the main body of the image forming apparatus. In such a construction, the intermediate transfer unit is fastened to the image forming apparatus main body, for example, by operation of a rotary lever or with screws.

For example, a known image forming apparatus includes a handle member fitted to one end of a pivot shaft and a lock member fitted to the other end of the pivot shaft, wherein as the handle member and hence the lock member pivots, the unit is locked on the apparatus main body.

For another example, a known image forming apparatus includes a unit that is removably inserted in the horizontal direction with respect to a main body frame and a locking mechanism for the unit. The locking mechanism comprises a lock member that is disposed on the unit so as to be movable to and fro in the direction orthogonal to the insertion-removal direction and that has an engagement projection engageable with an engaged portion on the main body frame and a preloading member that preloads the lock member in a first direction in which the engagement projection engages with the engaged portion.

SUMMARY

According to one aspect of the present disclosure, an image forming apparatus, includes a first unit which is dismountably mounted on a main body frame and a locking mechanism which releasably holds the first unit in a state mounted on the main body frame. The locking mechanism includes a handle portion, a lock member, and a preloading member. The handle portion is disposed on the first unit, and is movable to and fro in the mounting and dismounting directions of the first unit. The lock member is swingably disposed on the first unit, and has a hook portion that is engageable with an engaged portion formed on the main body frame. The preloading member preloads the lock member in a first direction in which the hook portion engages with the engaged portion. As the handle portion is moved in the dismounting direction, the lock member swings in a second direction opposite to the first direction against the preloading force of the preloading member so as to disengage the hook portion from the engaged portion, thereby enabling the first unit to be dismounted from the main body frame.

This and other objects of the present disclosure, and the specific benefits obtained according to the present disclosure, will become apparent from the description of embodiments which follows.

DETAILED DESCRIPTION

Figure 1:
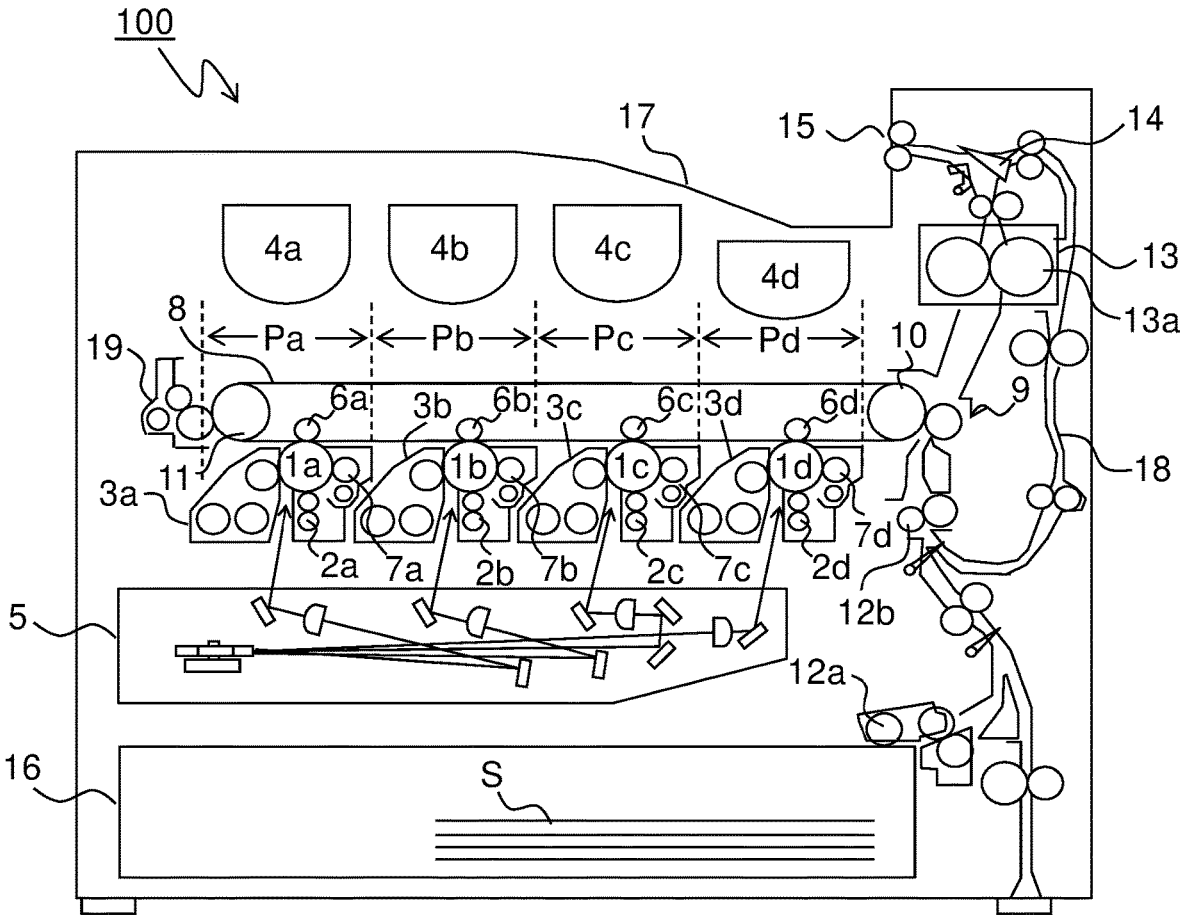
FIG. 1 is a sectional view schematically showing an internal construction of an image forming apparatus according to a first embodiment of the present disclosure.

Embodiments of the present disclosure will be described below with reference to the accompanying drawings. FIG. 1 is a side view schematically showing an internal construction of an image forming apparatus 100 according to a first embodiment of the present disclosure. The image forming apparatus 100 shown in FIG. 1 is what is called a tandem-type color printer, and is constructed as follows. Inside the main body of the image forming apparatus 100, four image forming portions Pa, Pb, Pc, and Pd are disposed from upstream (from in front of the apparatus; in FIG. 1, from left) down in the conveying direction. These image forming portions Pa to Pd correspond to four different colors (magenta, cyan, yellow, and black) respectively, and form a magenta, a cyan, a yellow, and a black image sequentially, each through the processes of electrostatic charging, exposure to light, image development, and image transfer.

In the image forming portions Pa to Pd respectively, photosensitive drums 1*a*, 1*b*, 1*c*, and 1*d* for carrying visible images (toner images) of the different colors are disposed. Adjacent to the image forming portions Pa to Pd, an endless intermediate transfer belt 8 that moves around counter-clockwise in FIG. 1 is disposed. The toner images formed on the photosensitive drums 1*a* to 1*d* are transferred sequentially to the intermediate transfer belt 8, which moves while in contact with the photosensitive drums 1*a* to 1*d*, and are then transferred at once to a sheet S as one example of a recording medium. The images are then fixed to the sheet S in a fixing portion 13, and the sheet S is then discharged out of the main body of the image forming apparatus 100. While the photosensitive drums 1*a* to 1*d* are rotated clockwise in FIG. 1, an image forming process is performed with respect to each of the photosensitive drums 1*a* to 1*d*.

Sheets S to which toner images are to be transferred are stored in a sheet cassette 16 in a lower part of the main body of the image forming apparatus 100, and are conveyed to a secondary transfer roller 9 via a sheet feed roller 12*a* and a pair of registration rollers 12*b*.

Next, the image forming portions Pa to Pd will be described. Around the photosensitive drums 1*a* to 1*d*, there are arranged, along the drum rotation direction (in FIG. 1, clockwise), charging devices 2*a* to 2*d*, developing devices 3*a* to 3*d*, and cleaning devices 7*a* to 7*d* and, across the intermediate transfer belt 8, primary transfer rollers 6*a* to 6*d*. Upstream of the image forming portion Pa with respect to the movement direction of the intermediate transfer belt 8, a belt cleaning unit 19 is disposed which faces a tension roller 11 across the intermediate transfer belt 8. The belt cleaning unit 19 removes toner that is left over on the surface of the intermediate transfer belt 8.

Next, an image forming procedure in the image forming apparatus 100 will be described. When a user enters an instruction to start image formation, first, a main motor (not shown) starts to rotate the photosensitive drums 1*a* to 1*d*, and the charging devices 2*a* to 2*d* electrostatically charge the surfaces of the photosensitive drums 1*a* to 1*d* uniformly. Next, a beam of light (laser light) emitted from an exposure device 5 is shone on the surfaces of the photosensitive drums 1*a* to 1*d* so that electrostatic latent images are formed on the photosensitive drums 1*a* to 1*d* in accordance with an image signal.

The developing devices 3*a* to 3*d* are loaded with predetermined amounts of magenta, cyan, yellow, and black toner respectively. When, as toner image formation proceeds as will be described above, the proportion of toner in two-component developer loaded in any of the developing devices 3*a* to 3*d* falls below a prescribed value, toner is supplied to the developing device 3*a* to 3*d* from the corresponding one of toner containers 4*a* t 4*d*. The toner in the developer is fed from the developing devices 3*a* to 3*d* onto the photosensitive drums 1*a* to 1*d*, and electrostatically attach to these. Thus toner images are formed in accordance with the electrostatic latent images that have been formed through exposure to the light from the exposure device 5.

Then the primary transfer rollers 6*a* to 6*d* produce an electric field at a predetermined transfer voltage between the primary transfer rollers 6*a* to 6*d* and the photosensitive drums 1*a* to 1*d*, and the magenta, cyan, yellow, and black toner images on the photosensitive drums 1*a* to 1*d* are primarily transferred to the intermediate transfer belt 8. These images of four colors are formed in a predetermined positional relationship with each other that is determined beforehand to form a predetermined full-color image. Thereafter, in preparation for the subsequently performed formation of new electrostatic latent images, the toner left over on the surfaces of the photosensitive drums 1*a* to 1*d* is removed by the cleaning devices 7*a* to 7*d*.

When, as a belt driving motor (not shown) drives a driving roller 10 to rotate, the intermediate transfer belt 8 starts to move around counter-clockwise, and a sheet S is conveyed, with predetermined timing, from the pair of registration rollers 12*b* to a secondary transfer roller 9, which is provided adjacent to the intermediate transfer belt 8, so that a full-color image is transferred. The sheet S having the toner images transferred to it is conveyed to a fixing portion 13. The toner left over on the surface of the 8 is removed by the belt cleaning unit 19.

The sheet S conveyed into the fixing portion 13 is heated and pressed by a pair of fixing rollers 13*a* so that the toner images are fixed to the surface of the sheet S, and thereby the predetermined full-color image is formed. The sheet S having the full-color image formed on it is distributed, by a branch portion 14 which branches into a plurality of directions, between different conveying directions so as to be discharged as it is, or after being fed to a duplex conveyance passage 18 and subjected to duplex printing, onto a discharge tray 17 by a pair of discharge rollers 15.

Figure 2:
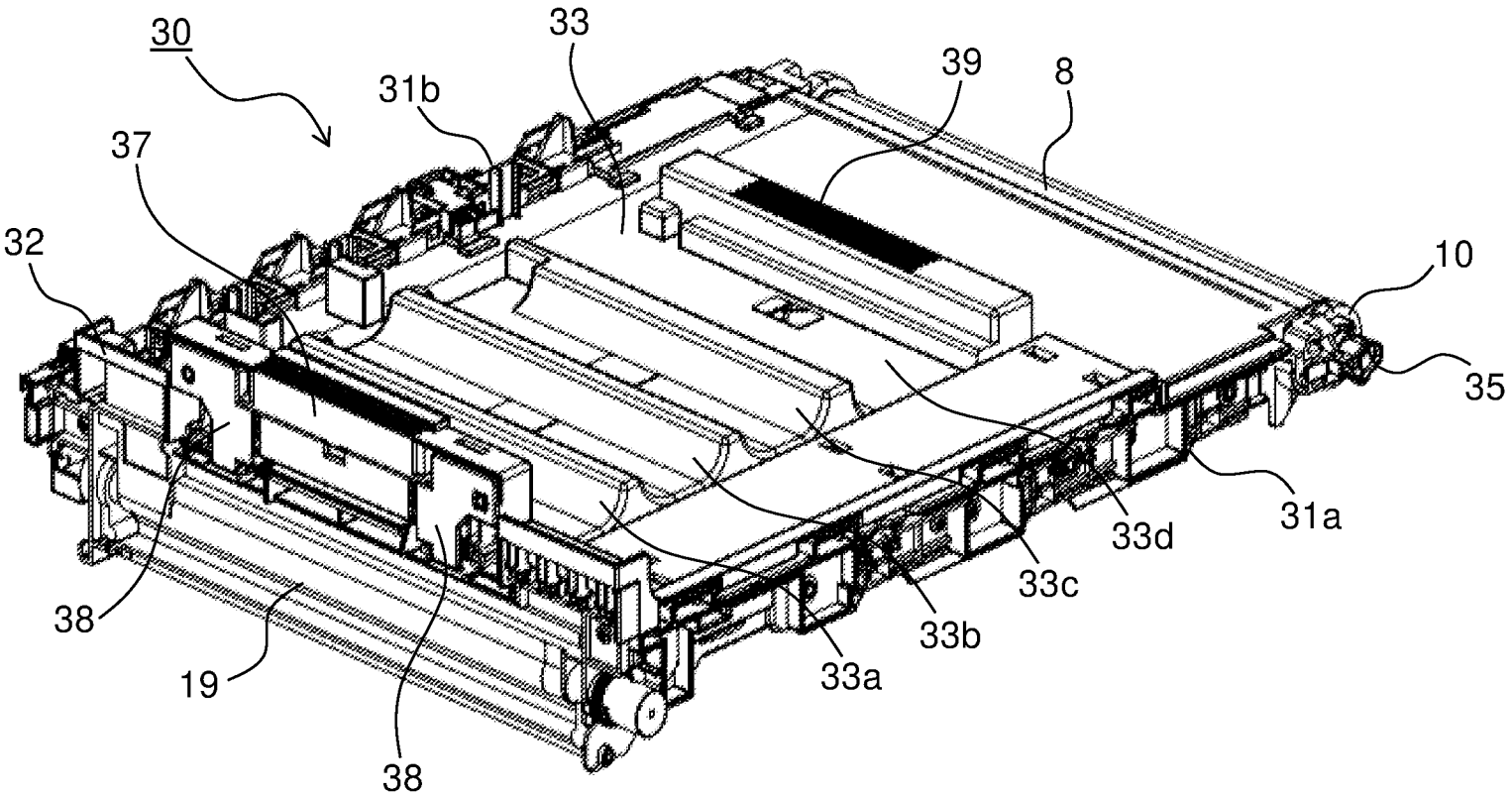
FIG. 2 is an exterior perspective view of an intermediate transfer unit as seen from where a belt cleaning unit is provided.

FIG. 2 is an exterior perspective view of an intermediate transfer unit 30 (first unit) as seen from where the belt cleaning unit 19 is provided. As shown in FIG. 2, the intermediate transfer unit 30 has a pair of side frames 31*a* and 31*b*, a coupling frame 32, and a top frame 33. The side frames 31*a* and 31*b* support rotatably a plurality of suspension rollers including the driving roller 10, the tension roller 11, and the primary transfer rollers 6*a* to 6*d*. The driving roller 10 is, at opposite ends of its rotary shaft, fitted with bushes (bearing members) 35. With the intermediate transfer unit 30 mounted in the image forming apparatus 100, the bushes 35 fit in positioning portions 101*a* (see FIG. 11) on a main body frame 101.

The coupling frame 32 is fastened so as to bridge between one end parts (near-left parts in FIG. 2) of the side frames 31*a* and 31*b*. In a top part of the coupling frame 32, a first handle portion 37 is provided, and at the left and right sides of the first handle portion 37, a pair of cover members 38 is fitted.

The top frame 33 is fastened so as to bridge between top pars of the side frames 31*a* and 31*b*. On the top frame 33, there are provided toner container seats 33*a* to 33*d* on which the toner containers 4*a* to 4*d* (second unit; see FIG. 1) are seated as well as a second handle portion 39.

Figure 3:
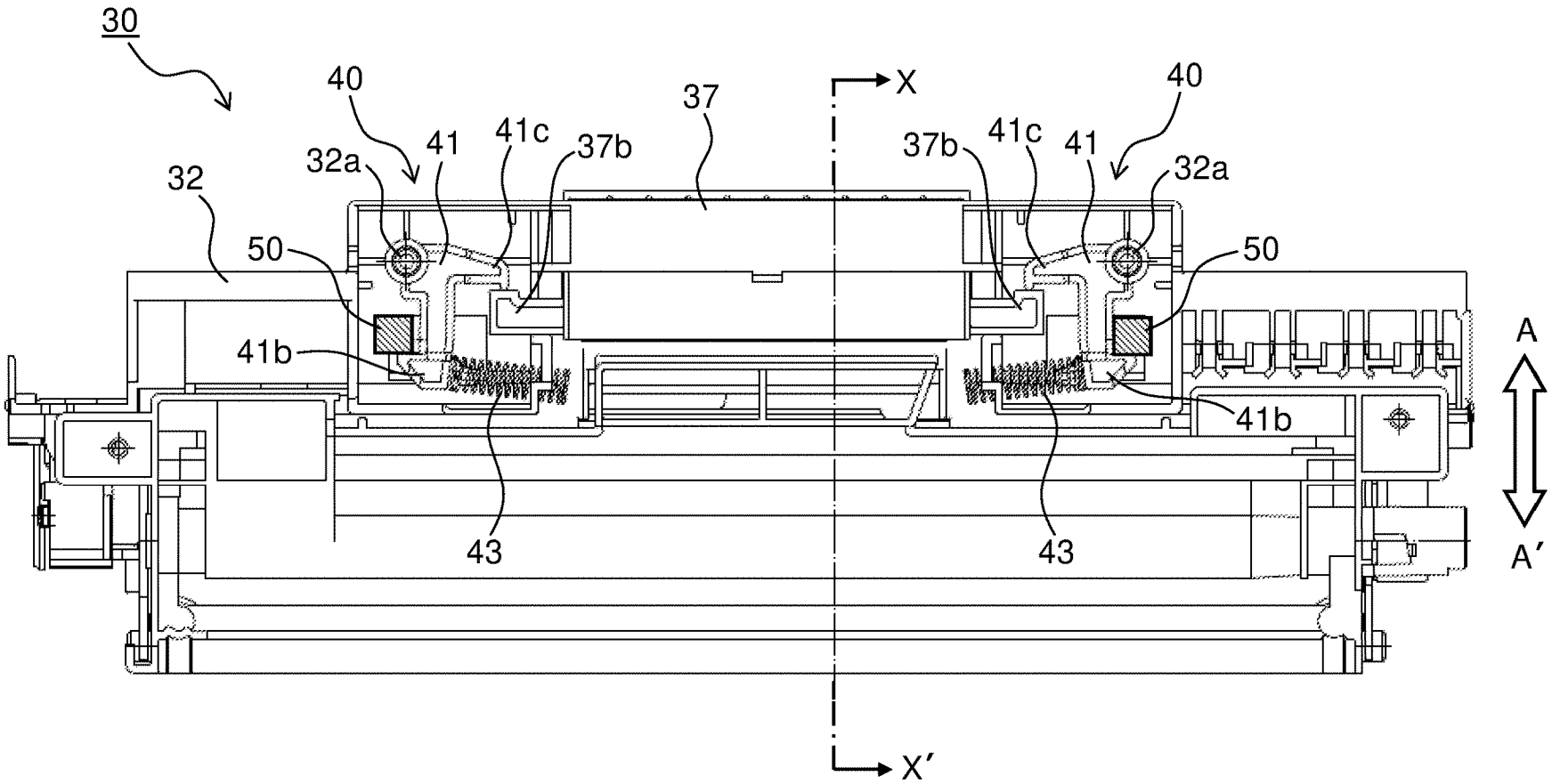
FIG. 3 is a side view of the intermediate transfer unit with cover members removed from a coupling frame.
Figure 4:
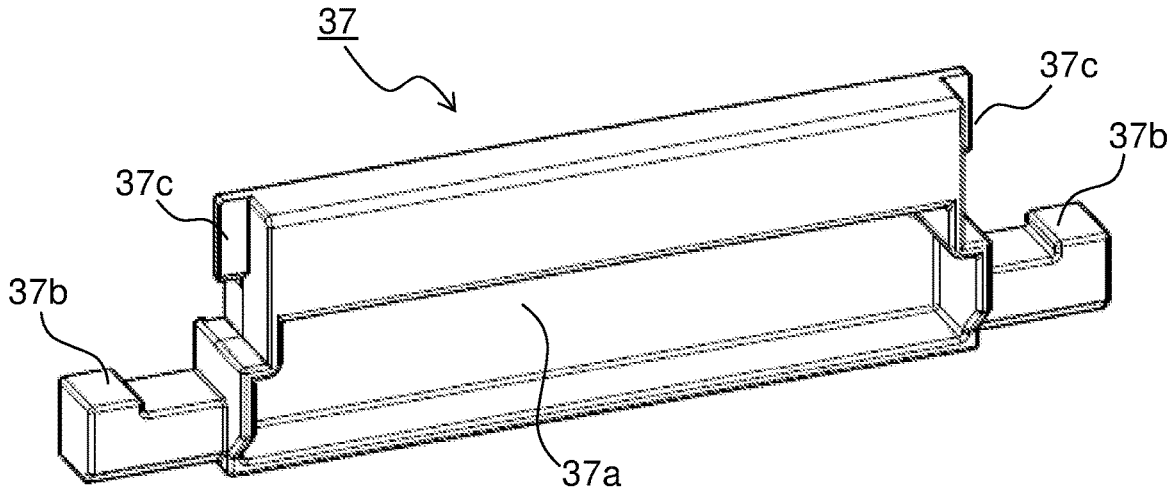
FIG. 4 is an exterior perspective view of a first handle portion as seen from behind FIG. 3.
Figure 5:
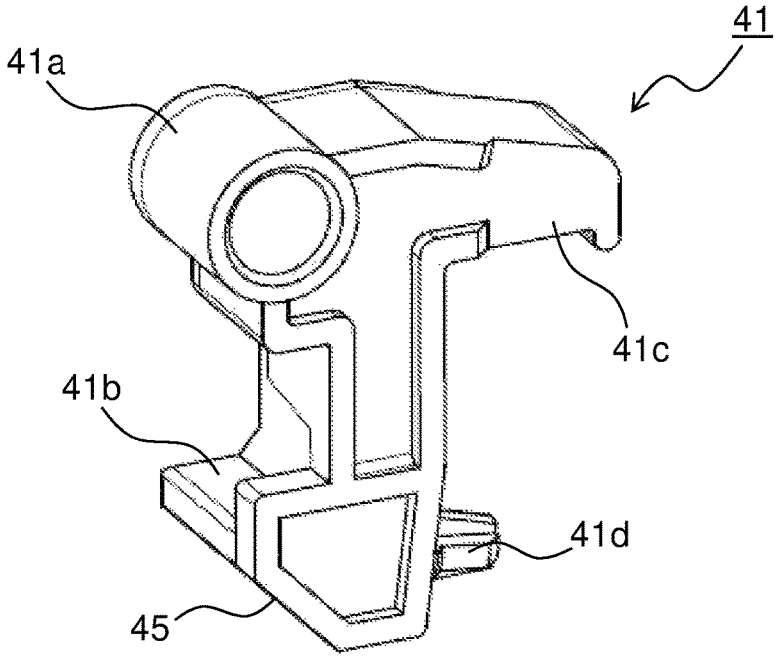
FIG. 5 is a perspective view of a lock member disposed inside the cover member.

FIG. 3 is a side view of the intermediate transfer unit 30 with the cover members 38 removed from the coupling frame 32, showing the intermediate transfer unit 30 in a state mounted in the image forming apparatus 100. FIG. 4 is an exterior perspective view of the first handle portion 37 as seen from behind FIG. 3, and FIG. 5 is a perspective view of a lock member 41 disposed inside the cover members 38. Now, with reference to FIGS. 3 to 5, a locking mechanism 40 for the intermediate transfer unit 30 will be described in detail. In the drawings referred to below, the dismounting and mounting directions of the intermediate transfer unit 30 as observed at its coupling frame 32 side are indicated by arrows A and A' respectively.

Figure 11:
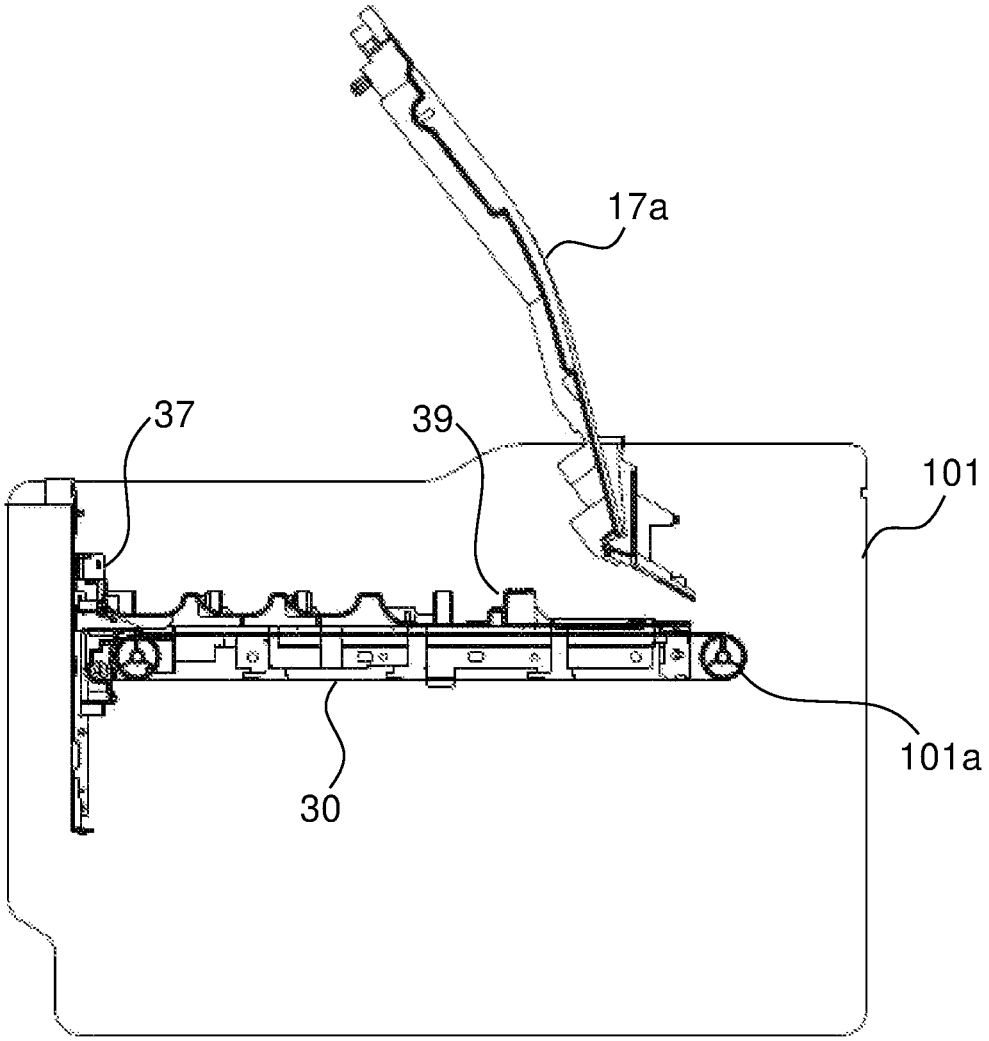
FIG. 11 is a side view showing the intermediate transfer unit in a state mounted on the main body frame.

As shown in FIG. 3, the coupling frame 32 includes a locking mechanism 40 which releasably holds the intermediate transfer unit 30 on the main body frame 101 (see FIG. 11). The locking mechanism 40 includes the first handle portion 37, lock members 41, and compression springs 43. A pair of lock members 41, and likewise a pair of compression springs 43, is provided one at each of the left and right sides of the first handle portion 37.

As shown in FIG. 4, the first handle portion 37 has a recessed portion 37*a*, protruding portions 37*b*, and guide ribs 37*c*. The recessed portion 37*a* is a recess in which the user puts fingers when mounting and dismounting the intermediate transfer unit 30 in and from the image forming apparatus 100. A pair of protruding portions 37*b*, and likewise a pair of guide ribs 37*c*, is formed one on each of the left and right side surfaces of the first handle portion 37. The protruding portions 37*b* protrude from a lower part of the first handle portion 37. The guide ribs 37*c* extend in the up-down direction along the side surfaces of the first handle portion 37. The guide ribs 37*c* engage with rail grooves (not shown) in the coupling frame 32, and thereby the first handle portion 37 is supported so as to be movable to and fro in the up-down direction with respect to the coupling frame 32.

As shown in FIG. 5, the lock member 41 has a boss portion 41*a*, a hook portion 41*b*, an arm portion 41*c*, and a spring holding projection 41*d*. The boss portion 41*a* is fitted rotatably around a pivot shaft 32*a* formed on the coupling frame 32. The hook portion 41*b* extends radially from the boss portion 41*a*, and is engageable with an engaged portion 50 (see FIG. 3) on the main body frame 101. On the outer side of the tip of the hook portion 41*b*, an inclined surface 45 is formed which is inclined in the swinging direction of the lock member 41.

The arm portion 41*c* extends from the boss portion 41*a* in a direction different from the hook portion 41*b* (in a direction substantially perpendicular to the hook portion 41*b*), and is in contact with the protruding portion 37*b* of the first handle portion 37. The spring holding projection 41*d* protrudes such that its diameter decreases from a base portion, on the back side of the hook portion 41*b*, to a tip portion, and the base portion has an outer diameter (maximum diameter) approximately equal to the inner diameter of the compression spring 43.

The compression spring 43 is at one end fastened to the spring holding projection 41*d* on the lock member 41 and is at the other end fastened to a spring fastening portion (not shown) on the coupling frame 32. The compression spring 43 preloads the lock member 41 in a direction (first direction) in which the hook portion 41*b* engages with the engaged portion 50.

Figure 6:
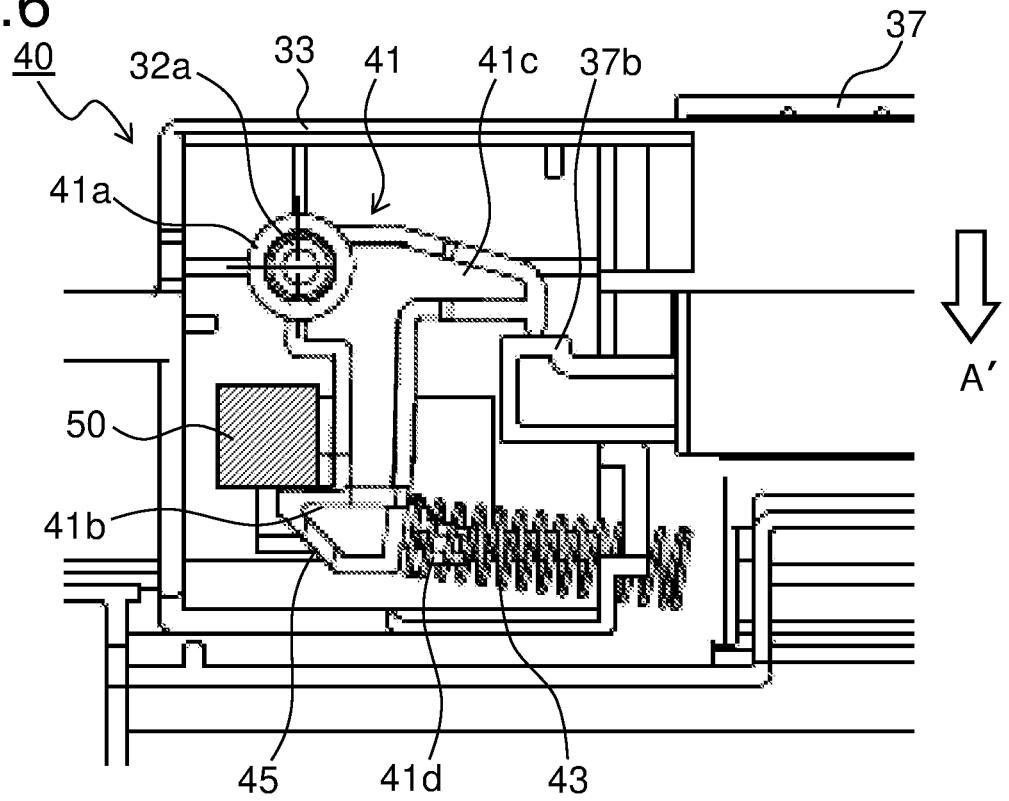
FIG. 6 is an enlarged view of the locking mechanism in FIG. 3, showing a state where the lock member and an engaged portion are in engagement.
Figure 7:
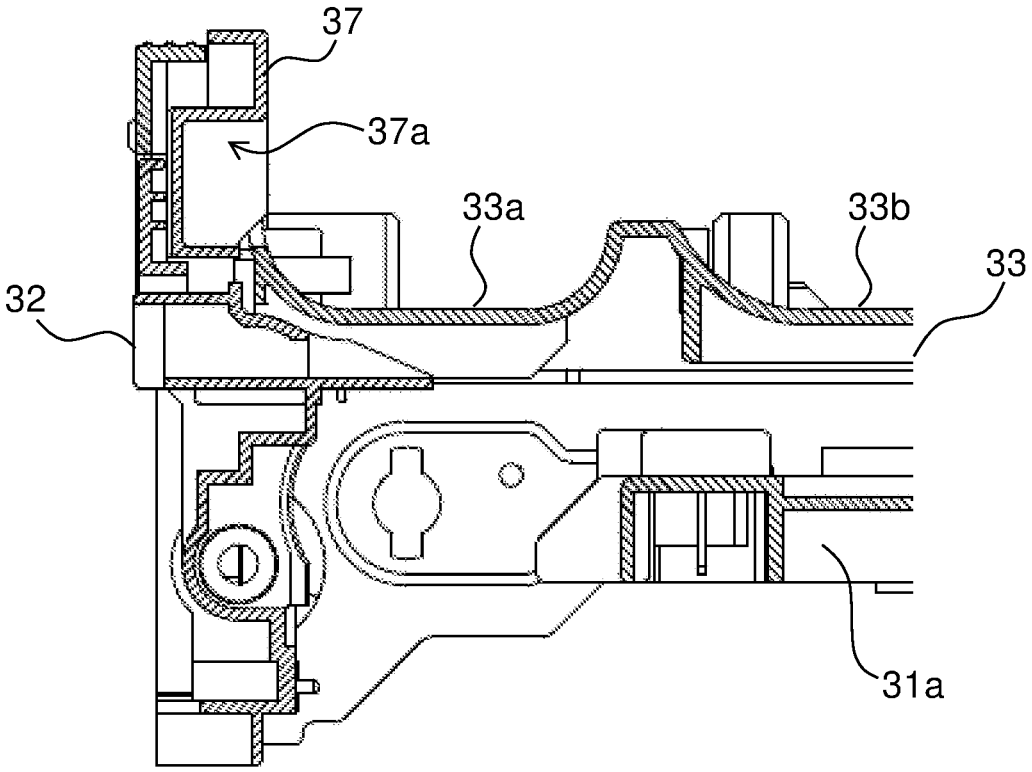
FIG. 7 is a side sectional view around a coupling frame of the intermediate transfer unit in FIG. 3.

Next, operation of releasing the locking mechanism 40 for the intermediate transfer unit 30 with respect to the main body frame 101 will be described. FIG. 6 is an enlarged view of the locking mechanism 40 in FIG. 3, showing a state where the lock member 41 and the engaged portion 50 are in engagement. FIG. 7 is a side sectional view (a sectional view as seen from the direction indicated by arrows XX' in FIG. 3) around the coupling frame 32 of the intermediate transfer unit 30 in FIG. 3. While the following description deals with the locking mechanism 40 at the left side of the first handle portion 37, it equally applies to the locking mechanism 40 at the right side of the first handle portion 37 except that they are bilaterally symmetric.

As shown in FIG. 6, with the intermediate transfer unit 30 mounted on the main body frame 101, the hook portion 41*b* of the lock member 41 is in engagement with the engaged portion 50. The lock member 41 is preloaded by the compression spring 43 in a direction (first direction; in FIG. 6, clockwise) in which the lock member 41 approaches the engaged portion 50. Thus the lock member 41 and the engaged portion 50 are kept in engagement, and the intermediate transfer unit 30 is restrained from being dismounted.

The arm portion 41*c* of the lock member 41 is, from above (from upstream in the mounting direction of the intermediate transfer unit 30), in contact with the top surface of the protruding portion 37*b* of the first handle portion 37. Thus the protruding portion 37*b* is acted on by the preloading force of the compression spring 43 via the lock member 41. Specifically, the first handle portion 37 is preloaded by the preloading force of the compression spring 43 in the mounting direction (direction of arrow A') of the intermediate transfer unit 30.

Figure 8:
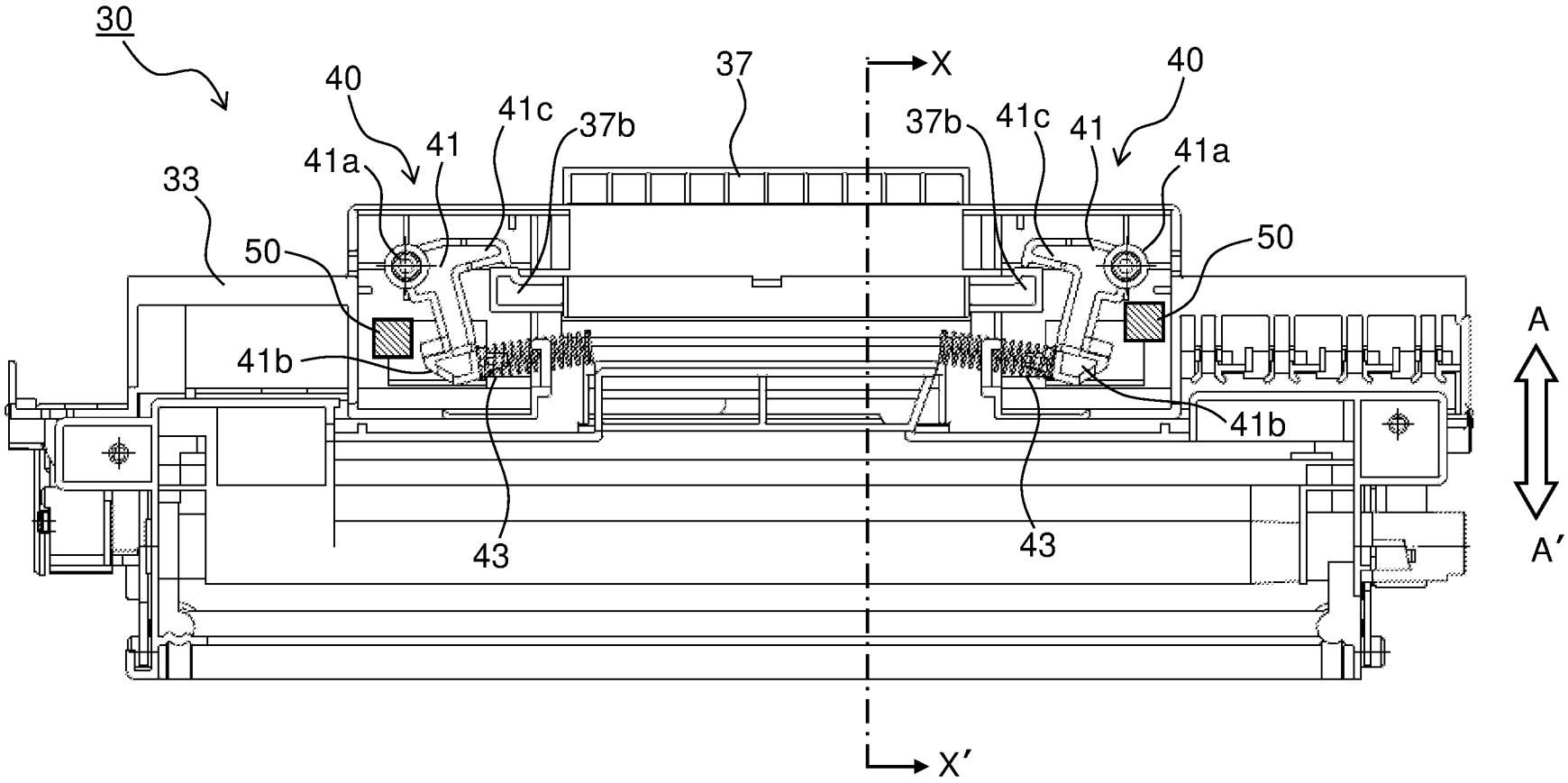
FIG. 8 is a side view of the coupling frame, showing a state where the first handle portion has been raised from the state in FIG. 3.
Figure 9:
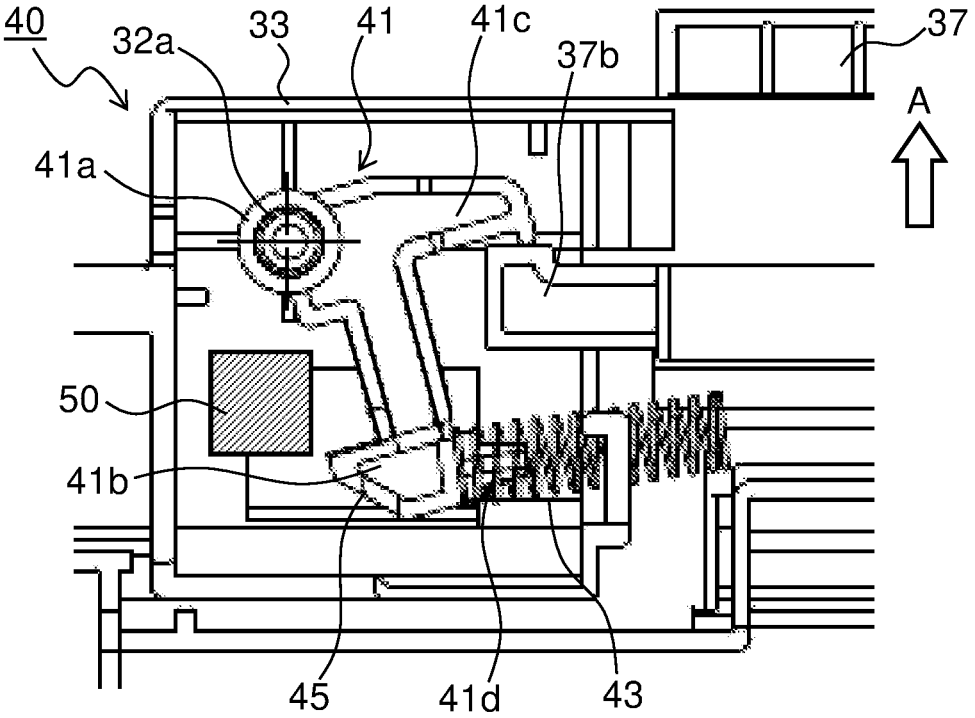
FIG. 9 is an enlarged view of the locking mechanism in FIG. 8, showing a state where the lock member and the engaged portion are out of engagement.
Figure 10:
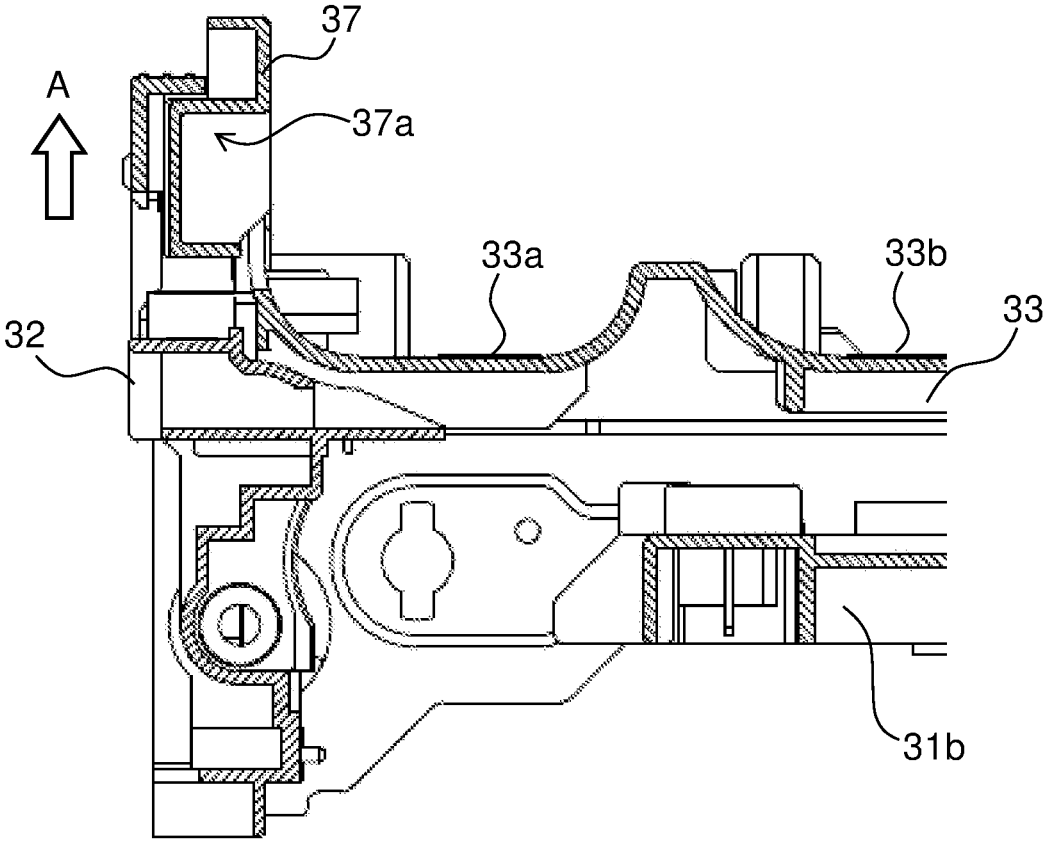
FIG. 10 is a side sectional view around the coupling frame of the intermediate transfer unit in FIG. 8.

FIG. 8 is a side view of the coupling frame 32 in a state where the first handle portion 37 has been raised from the state in FIG. 3. FIG. 9 is an enlarged view of the locking mechanism 40 in FIG. 8, showing a state in which the lock member 41 and the engaged portion 50 are out of engagement. FIG. 10 is a side sectional view (a sectional view as seen from the direction of arrows XX' in FIG. 8) around the coupling frame 32 of the intermediate transfer unit 30 in FIG. 8.

To release the locking mechanism 40 for the intermediate transfer unit 30, the user holds the first handle portion 37 with fingers put in the recessed portion 37*a*, and as shown in FIG. 10, raises the first handle portion 37 upward (in the direction of arrow A) against the preloading force of the compression spring 43. As a result, as shown in FIGS. 8 and 9, the protruding portion 37*b* of the first handle portion 37 pushes up the arm portion 41*c* of the lock member 41, and thus the lock member 41 rotates counter-clockwise.

Consequently the hook portion 41*b* swings in a direction (second direction; rightward in FIG. 9) receding from the engaged portion 50 while compressing the compression spring 43, and the hook portion 41*b* and the engaged portion 50 disengage from each other. This enables the intermediate transfer unit 30 to be dismounted.

Figure 12:
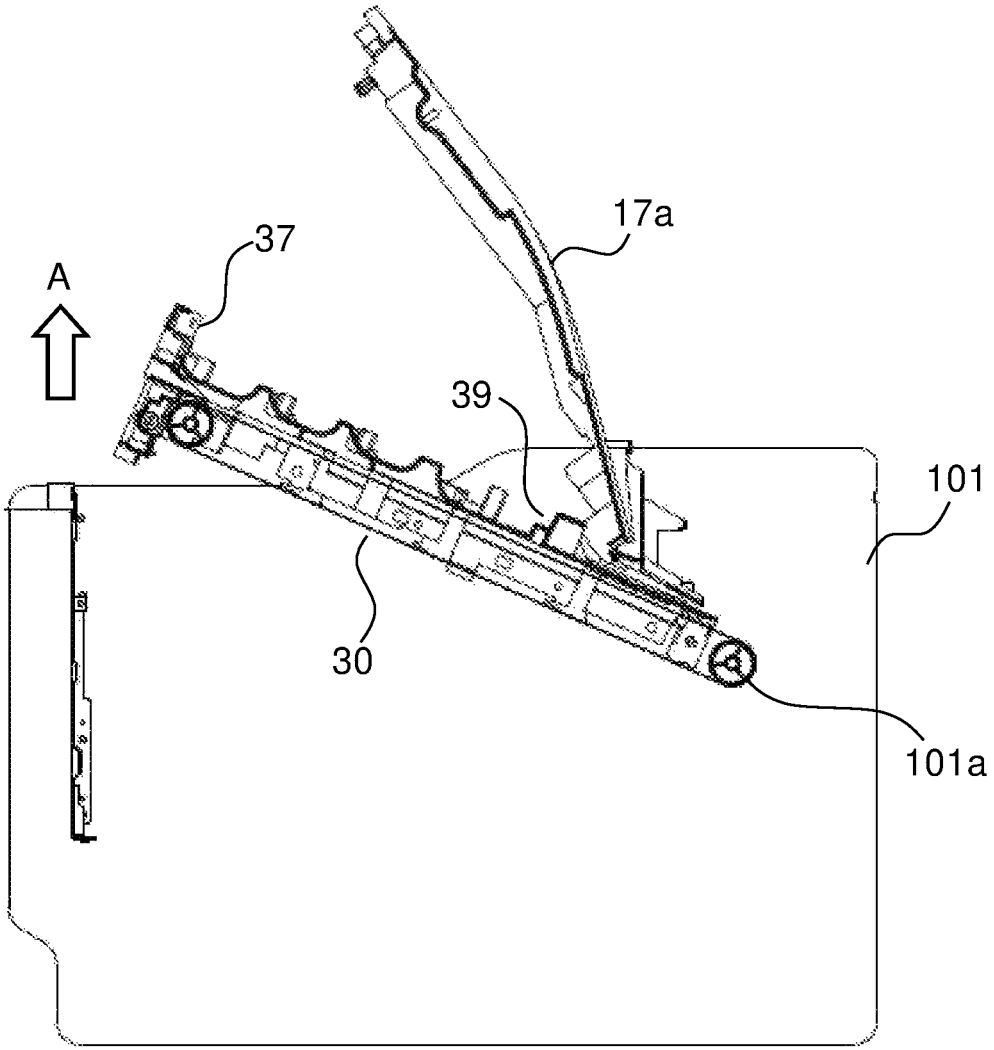
FIG. 12 is a side view showing the intermediate transfer unit in a state immediately before being dismounted from the main body frame.

FIG. 11 is a side view of the intermediate transfer unit 30 in a state mounted on the main body frame 101. FIG. 12 is a side view of the intermediate transfer unit 30 in a state immediately before being dismounted from the main body frame 101.

To dismount the intermediate transfer unit 30 from the main body frame 101, the user first opens an open-close cover 17*a* that constitutes the discharge tray 17 (see FIG. 1) and removes the toner containers 4*a* to 4*d* (see FIG. 1) to achieve the state in FIG. 11. Next, the user, while keeping the first handle portion 37 raised as shown in FIG. 10, lifts upward (dismounting direction; direction of arrow A) an apparatus front-side (left-side in FIG. 11) end part of the intermediate transfer unit 30. Having lifted that part up to a predetermined angle as shown in FIG. 12, the user then holds the second handle portion 39 together with the first handle portion 37, and pulls them to in front of the apparatus so that an apparatus rear-side (right-side in FIG. 12) end part (bushes 35) of the intermediate transfer unit 30 comes out of the positioning portions 101*a*. This completes the dismounting of the intermediate transfer unit 30.

To mount the intermediate transfer unit 30 on the main body frame 101, the user first, while keeping lifted the apparatus front-side part of the intermediate transfer unit 30 as shown in FIG. 12, makes the apparatus rear-side end part (bushes 35) of the intermediate transfer unit 30 fit in the positioning portions 101*a*. The user then lowers the apparatus front-side part of the intermediate transfer unit 30 slowly downward (in the mounting direction, direction of arrow A').

Figure 13:
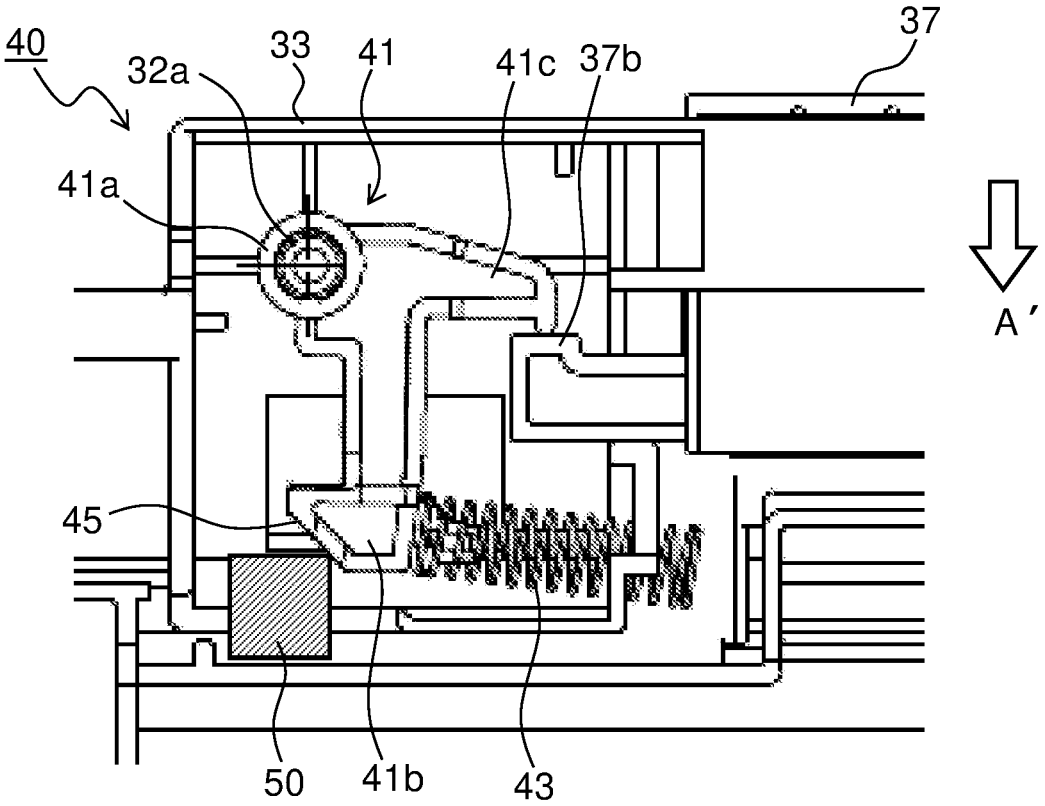
FIG. 13 is a diagram showing a state where, as the coupling frame of the intermediate transfer unit lowers, an inclined surface on a hook portion has made contact with the engaged portion.

When the apparatus front-side part of the intermediate transfer unit 30 lowers down to a predetermined position, as shown in FIG. 13, the inclined surface 45 formed on the hook portion 41*b* of the lock member 41 makes contact with the engaged portion 50 on the main body frame 101.

When the apparatus front-side part of the intermediate transfer unit 30 is lowered further from the state in FIG. 13, the inclined surface 45 receives a reactive drag from the engaged portion 50. The lock member 41 is supported swingably about the boss portion 41*a* as a pivot, and thus, of the drag received from the engaged portion 50, a component force that acts in the horizontal direction (rightward in FIG. 13) causes the hook portion 41*b* to swing in a direction (second direction; rightward in FIG. 13) receding from the engaged portion 50 against the preloading force of the compression spring 43.

When thereafter the lock member 41 swings in the second direction until the inclined surface 45 leaves the engaged portion 50, the tip end of the hook portion 41*b* lowers along the right side surface of the engaged portion 50. When the tip end of the hook portion 41*b* moves over a lower end part of the engaged portion 50, no drag is received from the engaged portion 50 any longer, and thus, under the preloading force of the compression spring 43, the lock member 41 swings in a direction (first direction; leftward in FIG. 13) approaching the engaged portion 50. As a result the hook portion 41*b* and the engaged portion 50 engages with each other as shown in FIGS. 3 and 6, and the intermediate transfer unit 30 is restrained from being dismounted. This completes the mounting of the intermediate transfer unit 30 on the main body frame 101.

With the construction described above, when the intermediate transfer unit 30 is dismounted from the image forming apparatus 100, simply holding and raising the first handle portion 37 permits the lock member 41 and the engaged portion 50 to disengage from each other. Moreover, the direction in which the first handle portion 37 is operated to release the locking mechanism 40 is the same (upward) as the direction in which the intermediate transfer unit 30 is dismounted, and thus it is possible to release the locking mechanism 40 and dismount the intermediate transfer unit 30 simultaneously. Accordingly the user can release the locking mechanism 40 for the intermediate transfer unit 30 through simple operation without fastening with screws or operating a rotary lever, and can thus replace the intermediate transfer unit 30 smoothly.

On the other hand, when the intermediate transfer unit 30 is mounted in the image forming apparatus 100, simply inserting the intermediate transfer unit 30 permits the hook portion 41*b* of the lock member 41 to engage with the engaged portion 50 on the main body frame 101. It is thus possible to lock the intermediate transfer unit 30 on the main body frame 101 automatically by the action of the locking mechanism 40 without any special operation.

Next, a second embodiment of the present disclosure will be described. In the first embodiment described previously, even if the intermediate transfer unit 30 is mounted on the main body frame 101 incompletely, this cannot be recognized. Thus image forming operation may be performed with the intermediate transfer unit 30 mounted incompletely, possibly leading to transfer failure or breakage in the intermediate transfer unit 30. To avoid that, an image forming apparatus 100 of the second embodiment includes a mechanism that allows recognition of whether the intermediate transfer unit 30 is mounted properly with respect to the main body frame 101.

Figure 14:
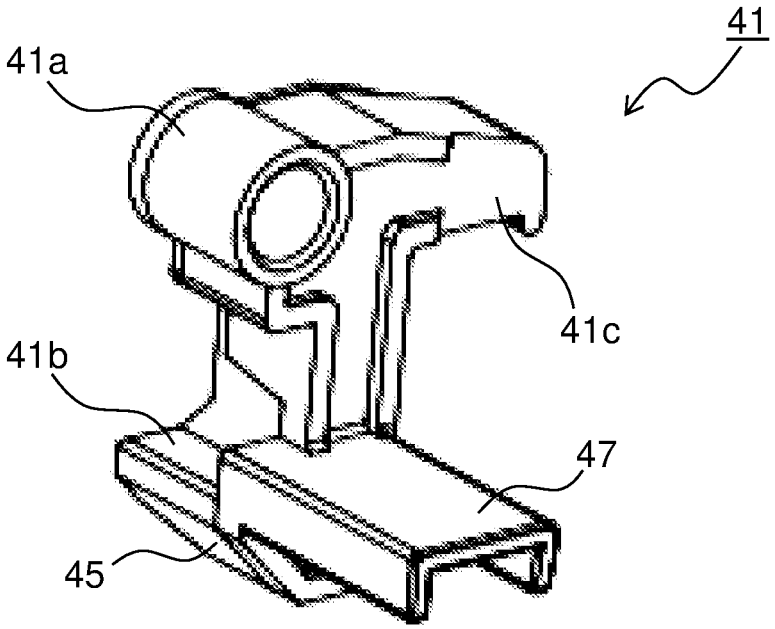
FIG. 14 is a perspective view of a lock member disposed inside a cover member in an image forming apparatus according to a second embodiment of the present disclosure.

FIG. 14 is a perspective view of a lock member 41 disposed inside the cover member 38 in the image forming apparatus 100 of the second embodiment. The lock member 41 has an elevated portion 47 that extends from a side surface of the hook portion 41*b* into the intermediate transfer unit 30 (rightward in FIG. 15) along the extension direction (axial direction of the pivot shaft 32*a*) of the boss portion 41*a*. In other respects, the lock member 41 is similar to that in the first embodiment shown in FIG. 7.

Figure 15:
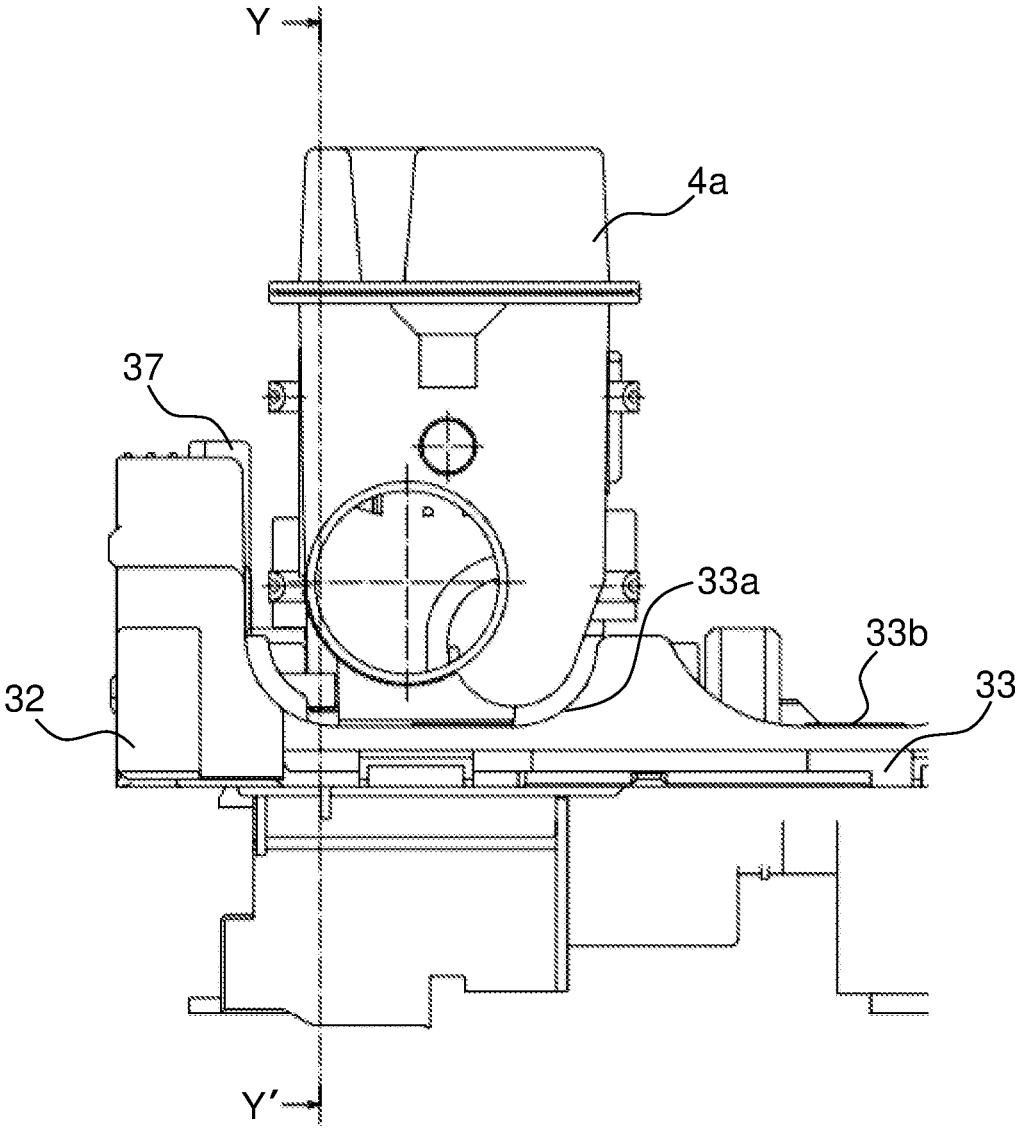
FIG. 15 is a side view around a coupling frame of an intermediate transfer unit in the image forming apparatus of the second embodiment, showing a state in which a toner container is placed on a container seat.
Figure 16:
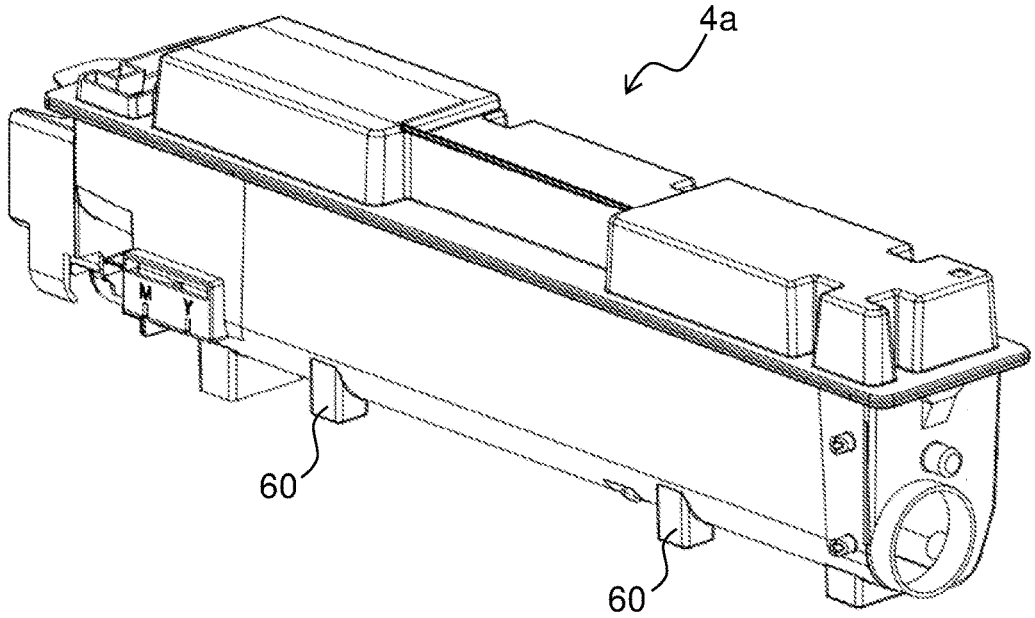
FIG. 16 is an exterior perspective view of a toner container.

FIG. 15 is a side view around the coupling frame 32 of the intermediate transfer unit 30, showing a state in which the toner container 4*a* is placed on the container seat 33*a*. FIG. 16 is an exterior perspective view of the toner container 4*a*. In a bottom part of the toner container 4*a*, leg portions 60 are formed at positions adjacent to the elevated portions 47 of the lock members 41.

Figure 17:
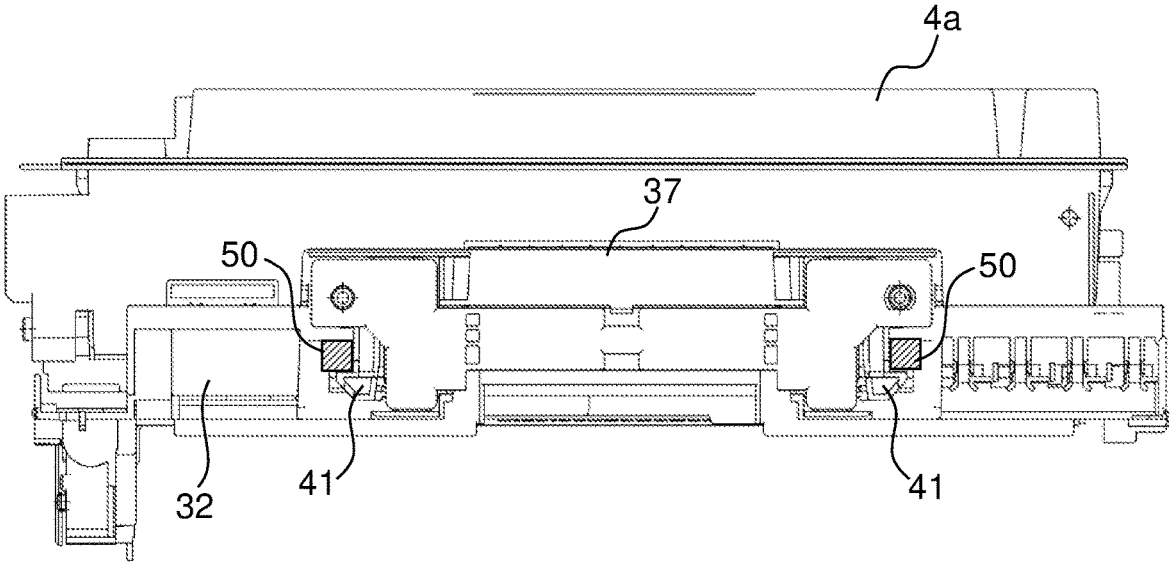
FIG. 17 is a front view around the coupling frame of the intermediate transfer unit with the toner container placed on it as seen from outside, showing a state where the intermediate transfer unit is mounted properly.
Figure 18:
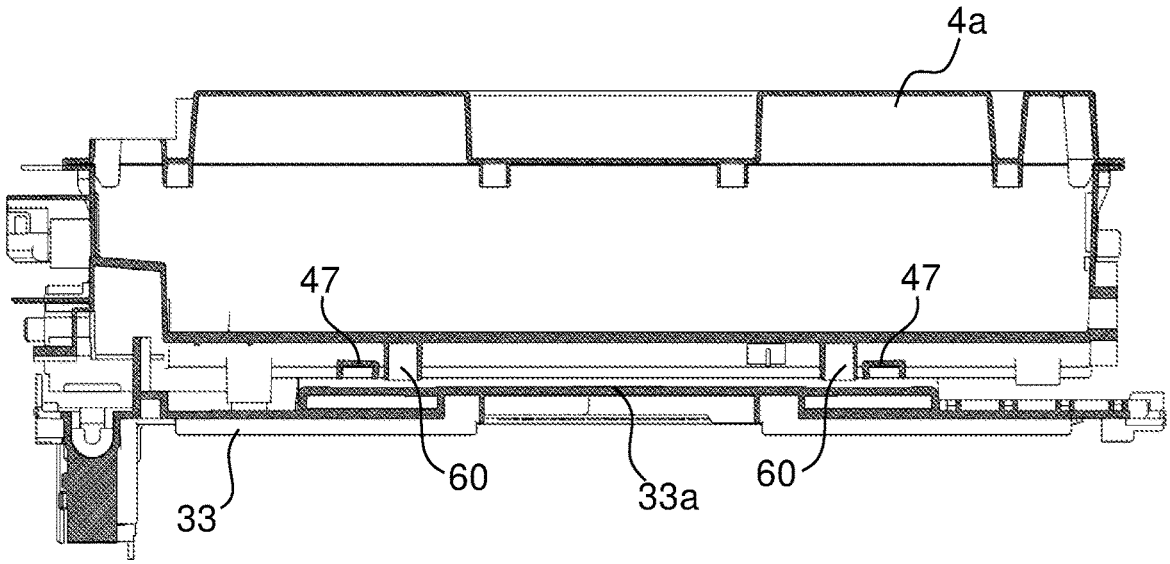
FIG. 18 is a front sectional view around elevated portions on the lock members in FIG. 17.

FIG. 17 is a front view around the coupling frame 32 of the intermediate transfer unit 30 with the toner container 4*a* mounted on it as seen from outside, showing a state where the intermediate transfer unit 30 is mounted properly. FIG. 18 is a front sectional view (a sectional view as seen from the direction of arrow YY' in FIG. 15) around the elevated portions 47 of the lock members 41 in FIG. 17.

With the intermediate transfer unit 30 mounted on the main body frame 101 properly, as shown in FIG. 17, the hook portions 41*b* of the lock members 41 are in complete engagement with the engaged portions 50. In this state, as shown in FIG. 18, the elevated portions 47 of the lock members 41 are retracted in a position where they are out of contact with the leg portions 60 of the toner container 4*a*. Thus, the toner container 4*a* is placed horizontally on the container seat 33*a* formed on the top frame 33 of the intermediate transfer unit 30.

Figure 19:
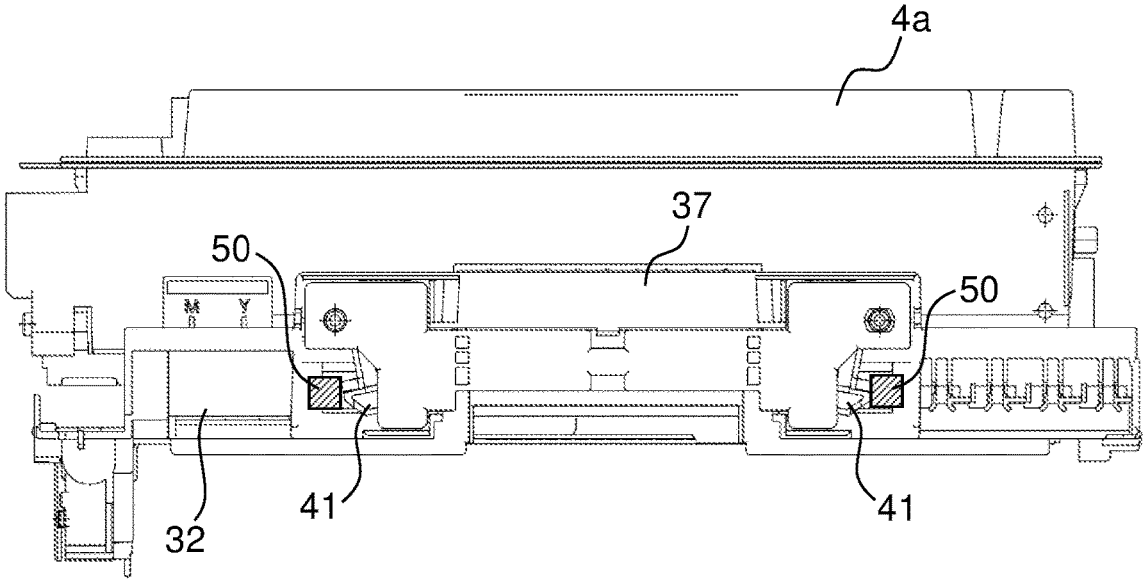
FIG. 19 is a front view around the coupling frame of the intermediate transfer unit with the toner container placed on it as seen from outside, showing a state where the intermediate transfer unit is mounted incompletely.
Figure 20:
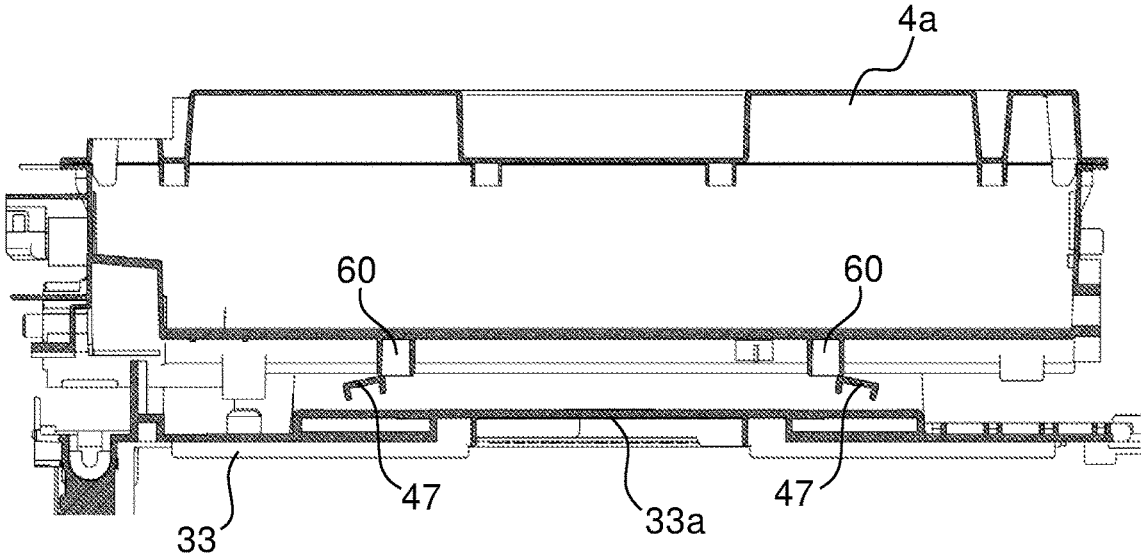
FIG. 20 is a front sectional view around the elevated portions on the lock members in FIG. 19.

FIG. 19 is a front view around the coupling frame 32 of the intermediate transfer unit 30 with the toner container 4*a* placed on it as seen from outside, showing a state where the intermediate transfer unit 30 is mounted incompletely. FIG. 20 is a front sectional view (a sectional view as seen from the direction of arrows YY' in FIG. 15) around the elevated portions 47 of the lock members 41 in FIG. 19.

With the intermediate transfer unit 30 mounted on the main body frame 101 incompletely, as shown in FIG. 19, the hook portions 41*b* of the lock members 41 are not in complete engagement with the engaged portions 50. More specifically, under the drag from the engaged portions 50, the lock members 41 swing in a direction (second direction; horizontally inward in FIG. 19) receding from the engaged portions 50.

In this state, as shown in FIG. 20, the elevated portions 47 of the lock members 41 are located at positions swung inward as compared with where they are in FIG. 18. Thus, when the toner container 4*a* is placed on the container seat 33*a*, the leg portions 60 interfere (make contact) with the elevated portions 47, so that the toner container 4*a* is placed in an inclined state. Thus, after the intermediate transfer unit 30 is mounted on the main body frame 101, by seeing whether the toner container 4*a* is placed horizontally, it is possible to recognize whether the intermediate transfer unit 30 is mounted properly.

Pushing down the toner container 4*a* from the state in FIGS. 19 and 20 causes the intermediate transfer unit 30 to be pushed down together with the toner container 4*a*; thus the tip ends of the hook portions 41*b* lower along the side surfaces of the engaged portions 50. When the tip ends of the hook portions 41*b* move over the lower end parts of the engaged portions 50, no drag is received from the engaged portions 50 any longer. Thus, under the preloading force of the compression springs 43, the lock members 41 come into complete engagement with the engaged portions 50 as shown in FIGS. 17 and 18.

Thus simply pushing down the toner container 4*a* permits both the intermediate transfer unit 30 and the toner container 4*a* to be mounted properly, and this eliminates the need to first remove the intermediate transfer unit 30 from the main body frame 101 and then mount it back. This contributes to improved workability of mounting.

The present disclosure is not limited by the embodiments described above and allows for any modifications without departure from the spirit of the present disclosure. For example, while in the embodiments described above one end of the intermediate transfer unit 30 is raised and lowered in the up-down direction about its other end as a pivot to perform mounting and dismounting, instead the intermediate transfer unit 30 may be inserted into and pulled out of the image forming apparatus 100 in the horizontal direction. The present disclosure is applicable to any units other than an intermediate transfer unit 30 so long as they are dismountably mounted in the main body of an image forming apparatus 100.

While in the embodiments described above the insertion of the intermediate transfer unit 30 into the main body frame 101 is accompanied by the swinging of the lock members 41 by use of the inclined surfaces 45 formed on the hook portions 41*b* of the lock members 41, instead the inclined surfaces 45 may be formed on the engaged portions 50.

The present disclosure applies not only to tandem-type color printers like the one in the embodiments described above but to a variety of image forming apparatuses, such as monochrome copiers, digital multifunction peripherals, facsimile machines, and laser printers, that incorporate a unit that is dismountably mounted in the unit of the image forming apparatus 100.

The present disclosure finds applications in image forming apparatuses that incorporate a unit that is dismountably mounted in an apparatus main body. Based on the present disclosure, it is possible to provide image forming apparatuses in which a unit dismountably mounted in an apparatus main body can be locked on and released from the apparatus main body with a simple construction.

What is claimed is:

1. An image forming apparatus, comprising:

a first unit dismountably mounted on a main body frame; and a locking mechanism releasably holding the first unit in a state mounted on the main body frame, wherein the locking mechanism incudes:

a handle portion disposed on the first unit, the handle portion being movable to and fro in mounting and dismounting directions of the first unit;

a lock member swingably disposed on the first unit, the lock member having a hook portion engageable with an engaged portion formed on the main body frame; and a preloading member preloading the lock member in a first direction in which the hook portion engages with the engaged portion, as the handle portion is moved in the dismounting direction, the lock member swings in a second direction opposite to the first direction against a preloading force of the preloading member so as to disengage the hook portion from the engaged portion, thereby enabling the first unit to be dismounted from the main body frame, the handle portion has a pair of protruding portions protruding from left and right side surfaces of the handle portion, the lock member comprises a pair of lock members disposed at left and right sides of the handle portion, the lock members each having:

a boss portion rotatably engaging with a pivot shaft formed on the first unit;

the hook portion radially extending from the boss portion; and an arm portion extending from the boss portion in a direction different from the hook portion, the arm portion making contact with the protruding portion from upstream in the mounting direction, with the first unit mounted on the main body frame, the handle portion is preloaded in the mounting direction by the preloading member via the lock member, and as the handle portion is moved in the dismounting direction; the protruding portion presses the arm portion in the dismounting direction against the preloading force of the preloading member and the lock member swings in the second direction so as to disengage the hook portion from the engaged portion.

2. The image forming apparatus according to claim 1, wherein under a drag that the lock member receives from the engaged portion when the first unit is mounted on the main body frame, the lock member swings in the second direction against the preloading force of the preloading member, and when the first unit is mounted in a predetermined position, under the preloading force of the preloading member, the lock member moves in the first direction to engage with the engaged portion.

3. The image forming apparatus according to claim 2, wherein on at least one of the hook portion and the engaged portion, in a part thereof that is in contact with the engaged portion or the hook portion when the first unit is mounted on the main body frame, an inclined surface that is inclined in a swinging direction of the lock member is formed.

4. The image forming apparatus according to claim 1, wherein the lock member swings about the pivot shaft, which is orthogonal to the mounting and dismounting directions, in a first direction in which the lock member recedes from the handle portion and a second direction in which the lock member approaches the handle portion.

5. An image forming apparatus, comprising:

a first unit dismountable mounted on a main body frame; and a locking mechanism releasably holding the first unit in a state mounted on the main body frame, wherein the locking mechanism incudes:

a handle portion disposed on the first unit, the handle portion being movable to and fro in mounting and dismounting directions of the first unit;

a lock member swingably disposed on the first unit, the lock member having a hook portion engageable with an engaged portion formed on the main body frame; and a preloading member preloading the lock member in a first direction in which the hook portion engages with the engaged portion, as the handle portion is moved in the dismounting direction, the lock member swings in a second direction opposite to the first direction against a preloading force of the preloading member so as to disengage the hook portion from the engaged portion, thereby enabling the first unit to be dismounted from the main body frame, the image forming apparatus, further include a second unit mounted on top of the first unit, and the lock member has an elevated portion that, with the hook portion and the engaged portion in engagement, permits mounting of the second unit and that, with the hook portion and the engaged portion out of engagement, restrain mounting of the second unit.

6. The image forming apparatus according to claim 5, wherein the handle portion has a pair of protruding portions protruding from left and right side surfaces of the handle portion, the lock member comprises a pair of lock members disposed at left and right sides of the handle portion, the lock members each having:

a boss portion rotatably engaging with a pivot shaft formed on the first unit;

the hook portion radially extending from the boss portion; and an arm portion extending from the boss portion in a direction different from the hook portion, the arm portion making contact with the protruding portion from upstream in the mounting direction, the elevated portion extends from a side surface of the hook portion to under the second unit along an axial direction of the pivot shaft, and with the hook portion and the engaged portion out of engagement, the elevated portion is located at a position in which the elevated portion is in contact with a leg portion formed on a bottom surface of the second unit, and when the hook portion engages with the engaged portion, the elevated portion retracts to a position where the elevated portion is out of contact with the leg portion.

7. The image forming apparatus according to claim 5, wherein pushing down the second unit causes the first unit to be mounted in a predetermined position, and under the preloading force of the preloading member, the lock member swings in the first direction so that the hook portion engages with the engaged portion.

8. The image forming apparatus according to claim 5, wherein the second unit is a toner container for storing toner with which to form an image on a recording medium.

9. An image forming apparatus, comprising:

a first unit dismountably mounted on a main body frame; and a locking mechanism releasably holding the first unit in a state mounted on the main body frame, wherein the locking mechanism incudes:

a handle portion disposed on the first unit, the handle portion being movable to and fro in mounting and dismounting directions of the first unit;

a lock member swingably disposed on the first unit, the lock member having a hook portion engageable with an engaged portion formed on the main body frame; and a preloading member preloading the lock member in a first direction in which the hook portion engages with the engaged portion, as the handle portion is moved in the dismounting direction, the lock member swings in a second direction opposite to the first direction against a preloading force of the preloading member so as to disengage the hook portion from the engaged portion, thereby enabling the first unit to be dismounted from the main body frame, and the first unit is an intermediate transfer unit including:

an intermediate transfer belt which is endless and on which toner images to be transferred to a recording medium are formed sequentially; and a plurality of suspension rollers around which the intermediate transfer belt is stretched.

10. The image forming apparatus according to claim 9, wherein the intermediate transfer unit has:

a pair of side frames supporting opposite end parts of the suspension rollers in an axial direction thereof; and a coupling frame coupled so as to bridge between one end parts of the side frames, the intermediate transfer unit is mountable and dismountable by raising and lowering a coupling frame-side part of the intermediate transfer unit with respect to the main body frame, and the locking mechanism is provided on the coupling frame.

* * * * *